United States Patent [19]

Misono et al.

[11] Patent Number: 5,051,648

[45] Date of Patent: Sep. 24, 1991

[54] FLAT TYPE LOW PRESSURE GAS DISCHARGE LAMP

[75] Inventors: Katsuhide Misono; Hisashi Honda, both of Kanagawa, Japan

[73] Assignee: Toshiba Lighting & Technology Corporation, Tokyo, Japan

[21] Appl. No.: 494,537

[22] Filed: Mar. 16, 1990

[30] Foreign Application Priority Data

Mar. 17, 1989 [JP] Japan ..... 1-065722

[51] Int. Cl.[5] ..... H01J 61/24; H01J 7/24

[52] U.S. Cl. ..... 313/13; 313/15; 313/44; 313/491; 313/494

[58] Field of Search ..... 313/13, 15, 44, 484, 313/485, 491, 493, 494; 324/410; 445/6, 27; 315/106, 115, 116

[56] References Cited

U.S. PATENT DOCUMENTS

| | | | |
|---|---|---|---|
| 2,755,400 | 7/1956 | Stiles | 315/115 |
| 3,886,393 | 5/1975 | Hinson | 313/485 X |
| 4,767,965 | 8/1988 | Yamano et al. | 313/493 X |
| 4,956,573 | 9/1990 | Smith et al. | 313/15 |

FOREIGN PATENT DOCUMENTS

| | | | |
|---|---|---|---|
| 60-225347 | 11/1985 | Japan . | |
| 0008827 | 1/1986 | Japan | 313/485 |
| 0103960 | 5/1987 | Japan | 313/493 |
| 62-208537 | 9/1987 | Japan . | |

OTHER PUBLICATIONS

M. A. Cayles, "Production of Resonance Radiation in Discharge Tubes of Non-Circular Cross-Section", British Journal of Applied Physics, vol. II, Nov. 1960.

J. F. Waymouth, "High-Pressure Mercury Lanes", Electric Discharge Lamps, MIT Press (12/1971), pp. 160-166.

Takeuchi et al., "Development of Large Cold Cathode Flat Fluorescent Lamp", Technical Research Report of Electronic Information Communication Learned Society, EID 87-64 (09/1988) pp. 1-6.

*Primary Examiner*—Donald J. Yusko
*Assistant Examiner*—Ashok Patel
*Attorney, Agent, or Firm*—Finnegan, Henderson, Farabow, Garrett, and Dunner

[57] ABSTRACT

The discharge space of a flat type fluorescent lamp in which a pair of electrodes are oppositely positioned for producing discharge therebetween establishes a predetermined elongated width W along the pair of electrodes and a prescribed height H in a direction perpendicular to the discharge direction. A fill including argon is sealed in the discharge space at a target pressure F (torr) which satisfies the following relationship when an aspect ratio F defined by the ratio of the predetermined elongated width W to the prescribed height H is equal to or greater than four and is equal to or less than eight: $10 \leqq P \leqq -5/2\ (F-4)+40$; and the following relationship when the aspect ratio F is equal to or greater than eight and is equal to or less than eighteen: $10 \leqq P \leqq 30$.

11 Claims, 5 Drawing Sheets

FLAT TYPE LOW PRESSURE GAS DISCHARGE LAMP

BACKGROUND OF THE INVENTION

1. Field of the Invention

The present invention relates, in general, to low pressure gas discharge lamps. In particular, the invention relates to a flat type low pressure gas discharge lamp which is applied to a liquid crystal display (LCD) apparatus, as a backlighting.

2. Description of the Related Art

As is well known, a low pressure gas discharge lamp, e.g., a fluorescent lamp, is used as a light source for a liquid crystal display apparatus. Essential features required as a light source for a liquid crystal display are a reduced thickness, a high brightness, and a uniformity of brightness.

Japanese Laid-open patent 62-208537 discloses a flat type fluorescent lamp which satisfies the above-described requirements. However, in such a flat type fluorescent lamp disclosed in the Japanese laid-open patent, when an aspect ratio F defined by the ratio between the elongated width W which is parallel to the electrode discharge surface and the height H of the flat type fluorescent lamp is greater than a prescribed value, undesirable phenomena, such as, a discharge concentration, a fluctuating positive column, etc., occur, resulting in unstable operation of the flat type fluorescent lamp.

The British Journal of Applied Physics, Vol. 11 (1960) 492498, authored by M. A. Cayless discloses the discharge concentration phenomenon in which discharge of the flat type fluorescent lamp concentrates as the above-described aspect ratio F increases. According to this Journal, the upper limit value of the aspect ratio F is 3.5~4, and, in particular, the discharge of the lamp is stable under a normal current density in the discharge space only when the aspect ratio F is less than 3.5. In addition, it has been considered that it is difficult to achieve stable operation when the aspect ratio F is more than 4 even if the current density of the discharge space is varied greatly.

It is preferable to increase the light radiating surface of the flat type fluorescent lamp when it is used as a light source for the liquid crystal display apparatus. It is also preferable to reduce the thickness (height H) of the lamp to achieve a desirable external shape of the liquid crystal display when it is used in the display apparatus. However, since the upper limit of the aspect ratio F of the lamp is limited, as described above, a plurality of flat type fluorescent lamps may be needed if the above-described flat type fluorescent lamp having a relatively small light radiating surface is applied to a relatively large liquid crystal display apparatus. Thus, the number of areas between the plurality of flat type fluorescent lamps increases resulting in irregularity of brightness of the display apparatus. In addition, increase in the number of flat type fluorescent lamps used in the display apparatus causes an increase in the number of lead elements requiring a large supporting space in the display apparatus. Thus, the application of the prior art design to LCDs may be limited, and the cost of manufacturing the display apparatus is high.

SUMMARY OF THE INVENTION

Accordingly, it is an object of the present invention to satisfy required features of a flat type fluorescent lamp by increasing the aspect ratio F of the lamp when the flat type fluorescent lamp is used as a backlighting.

To accomplish the above-object, a flat type low pressure discharge lamp includes a lamp body having a gas discharge space for radiating light, a pair of electrodes oppositely disposed in the discharge space for generating an alternating discharge therebetween in the discharge space when the appropriate potential is applied. The cross section of the discharge space has a predetermined elongated width W parallel to the discharge surface of the electrode pair and a prescribed height H in a direction perpendicular to the alternating discharge direction. The flat type fluorescent lamp also includes a fill gas essentially consisting of argon sealed in the discharge space at a target pressure P (torr) which satisfies the following relationship:

(i) when an aspect ratio F defined by the ratio of the predetermined elongated width W to the prescribed height H is equal to or greater than four and is equal to or less than eight, $$10 \leqq P \leqq -5/2(F-4)+40 \text{ and}$$

(ii) when the aspect ratio F is equal to or greater than eight and is equal to or less than eighteen, $$10 \leqq P \leqq 30.$$

BRIEF DESCRIPTION OF THE DRAWINGS

These and other objects and advantages of this invention will become apparent and more readily appreciated from the following detailed description of the presently preferred embodiment of the invention, taken in conjunction with the accompanying drawings of which:

FIG. 4 (*b*) is a cross sectional view illustrating another example of the flat type low pressure gas discharge lamp;

DETAILED DESCRIPTION OF THE PREFERRED EMBODIMENTS

Figure 1:
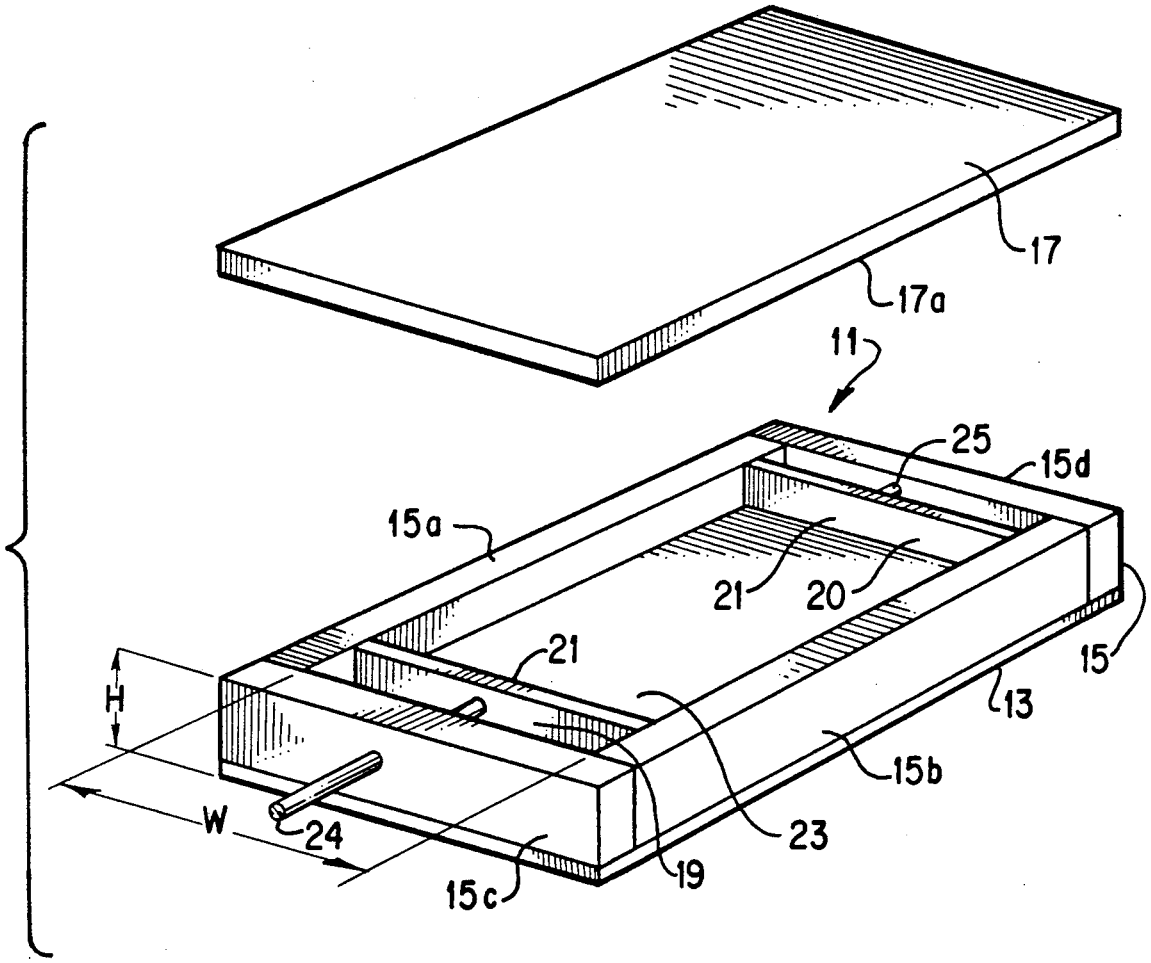
FIG. 1 is a schematic perspective view illustrating a flat type low pressure gas discharge lamp of one embodiment of the present invention when the lid plate is removed from the lamp.

Preferred embodiments of the present invention will now be described with reference to accompanying drawings. As shown in FIG. 1, a low pressure gas discharge lamp, here shown as fluorescent lamp 11, includes a rectangular shaped base plate 13, a frame shaped side wall 15 extending from one of the surfaces of base plate 13, and a rectangular shaped lid plate 17 to define an inner space 19. Base plate 13, side wall 15 and lid plate 17 are preferably made of glass. Lid plate 17 transmits light. A pair of plate shaped electrodes 21 are positioned opposite to one another in inner space 19. A pair of electrodes (hollow cathode) each of which is hollow and closed at one end may be used instead of the pair of plate shaped electrodes. The discharge surface area 20 of each electrode 21 is the same as that of a rectangular section of inner space 19 defined by opposite side wall elements 15*a*, 15*b*, base plate 13 and lid plate 17. A discharge space 23 is established between the pair of plate shaped electrodes 21. A fluorescent film 17*a* is formed on the one surface of lid plate 17 exposed to discharge space 23 to radiate visible rays. One surface of base plate 13 may be provided with a fluorescent material or a reflection film. One of the opposite ends of a first lead rod 24 is connected to one of the pair of electrodes 21, and the other end extends to the outside of fluorescent lamp 11 through one of the opposite elongated side wall elements 15*c* of frame shaped side wall 15. One of the opposite ends of a second lead rod 25 is connected to the other electrode 21, and the other end thereof also extends to the outside of fluorescent lamp 11 through the other elongated side wall element 15*d*.

Air in inner space 19 is exhausted by a well known exhausting device (not shown) through an exhausting pipe (not shown), and then inner space 19 is filled with a proper amount of argon and mercury.

In the above-described fluorescent lamp 11, an aspect ratio F is defined as follows:

$$F = W/H$$

where W (hereinafter referred to as width) is a distance between the opposite elongated side wall elements 15*a* and 15*b* exposed to discharge space 23, and H (hereinafter referred to as height) is a height of either of elongated side wall element 15*a* or 15*b* exposed to discharge space 23.

In this case, a pressure P (torr) of argon gas sealed in inner space 19 (discharge space 23) is determined to satisfy the following relationship:

$$10 \leqq P \leqq -5/2(F-4)+40 \quad (1)$$

when the aspect ratio F is equal to or greater than 4, and is equal to or less than 8.

Pressure P (torr) satisfies the following relationship:

$$10 \leqq P \leqq 30 \quad (2)$$

when the aspect ratio F is equal to or greater than 8, and is equal to or less than 18.

The above-described relationship between the aspect ratio F and the pressure P of argon sealed in inner space 19 of fluorescent lamp 11 was discovered based on an experiment carried out by the inventors of the present invention.

In this case, a stable discharge is maintained in fluorescent lamp 11 by regulating the current density (current value of a unit area perpendicular to the current flow direction in the discharge area) at a suitable value as long as a value of the pressure of argon sealed in inner space 19 satisfies the above-described relationship (1) or (2) even if the aspect ratio F is increased within the above-described ranges, i.e., $4 \leqq F \leqq 8$ or $8 \leqq F \leqq 18$, as compared with the aspect ratio F of the conventional fluorescent lamp.

The above-described relationship is derived from the following technical background. It is well known that the stability of discharge of the flat type fluorescent lamp depends on the aspect ratio F of the lamp, the pressure of rare gas mainly consisting of argon sealed in the inner space of the lamp and the current density in the discharge space of the lamp. The stability of discharge is hardly affected even though other parameters vary within a practical range.

Figure 2:
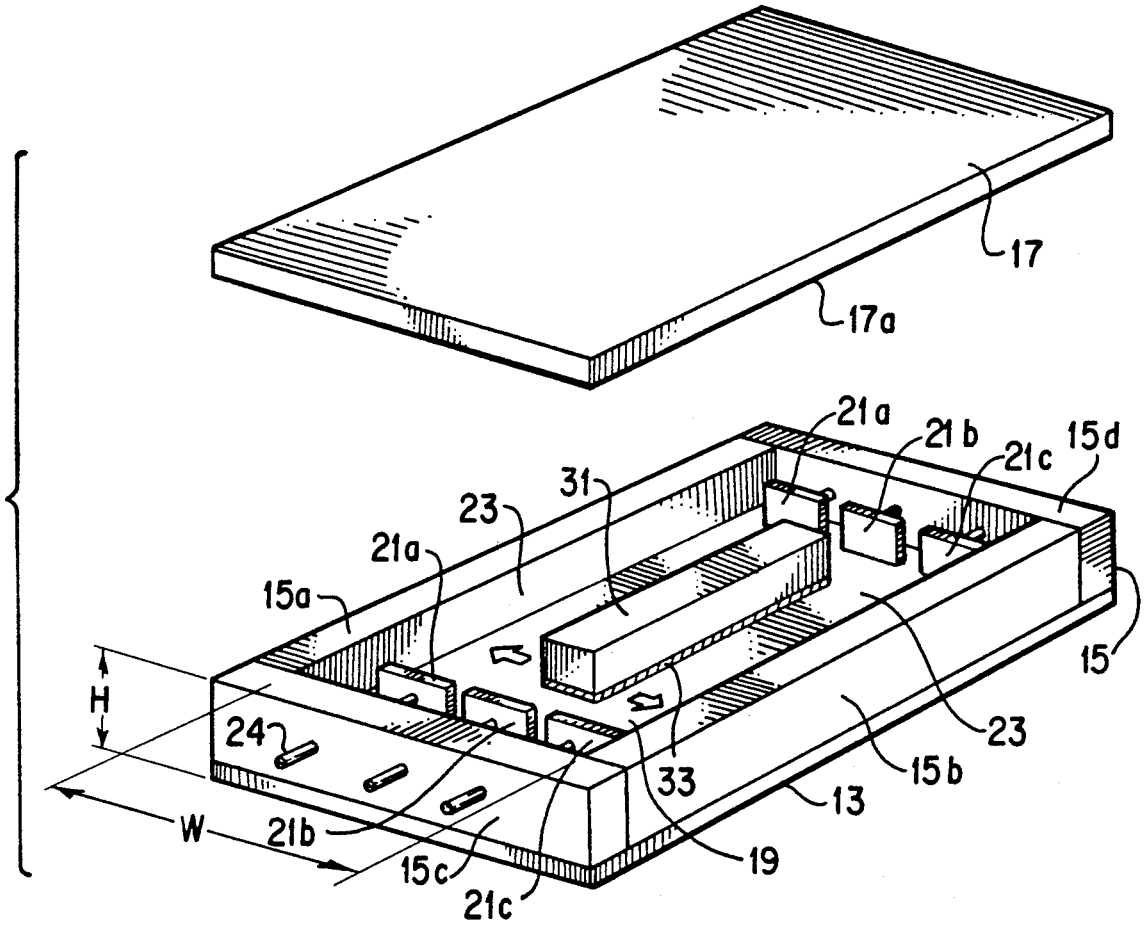
FIG. 2 is a schematic perspective view illustrating a flat type low pressure gas discharge lamp which is used to develop the present invention.

The experiment from which the above-described relationship between the aspect ratio F and the pressure P of argon sealed in inner space 19 of fluorescent lamp 11 was derived will now be described with reference to FIGS. 2 and 3. In FIG. 2, each of the pair of plate shaped electrodes 21 shown in FIG. 1 is divided into three electrode elements 21*a*, 21*b* and 21*c*. A bar shaped movable glass divider 31 is positioned in discharge space 23. A nickel plate 33 is bonded on the surface of divider 31 which contacts the inner surface of base plate 13. Divider 31 is moved parallel to the surfaces of the three pairs of divided electrode elements 21*a*, 21*b* and 21*c*, as shown in FIG. 2, by moving a magnet (not shown) along the outer surface of base plate 13. Thus, the dimensions of discharge space 23 is varied by moving divider 31.

As stated above, since width W of aspect ratio F is varied by reciprocally moving divider 31 as shown in FIG. 2, a selective discharge between three pairs of divided electrode elements 21*a*, 21*b* and 21*c* can be observed as aspect ratio F is varied. The experiment was carried out by changing the pressure P of argon filled in inner space 19 for various values of the aspect ratio F. The results of the experiment are shown in FIG. 3. In this case, a 40 kHz sine wave voltage was respectively applied to the three pairs of divided electrode elements 21*a*, 21*b* and 21*c*.

Figure 3:
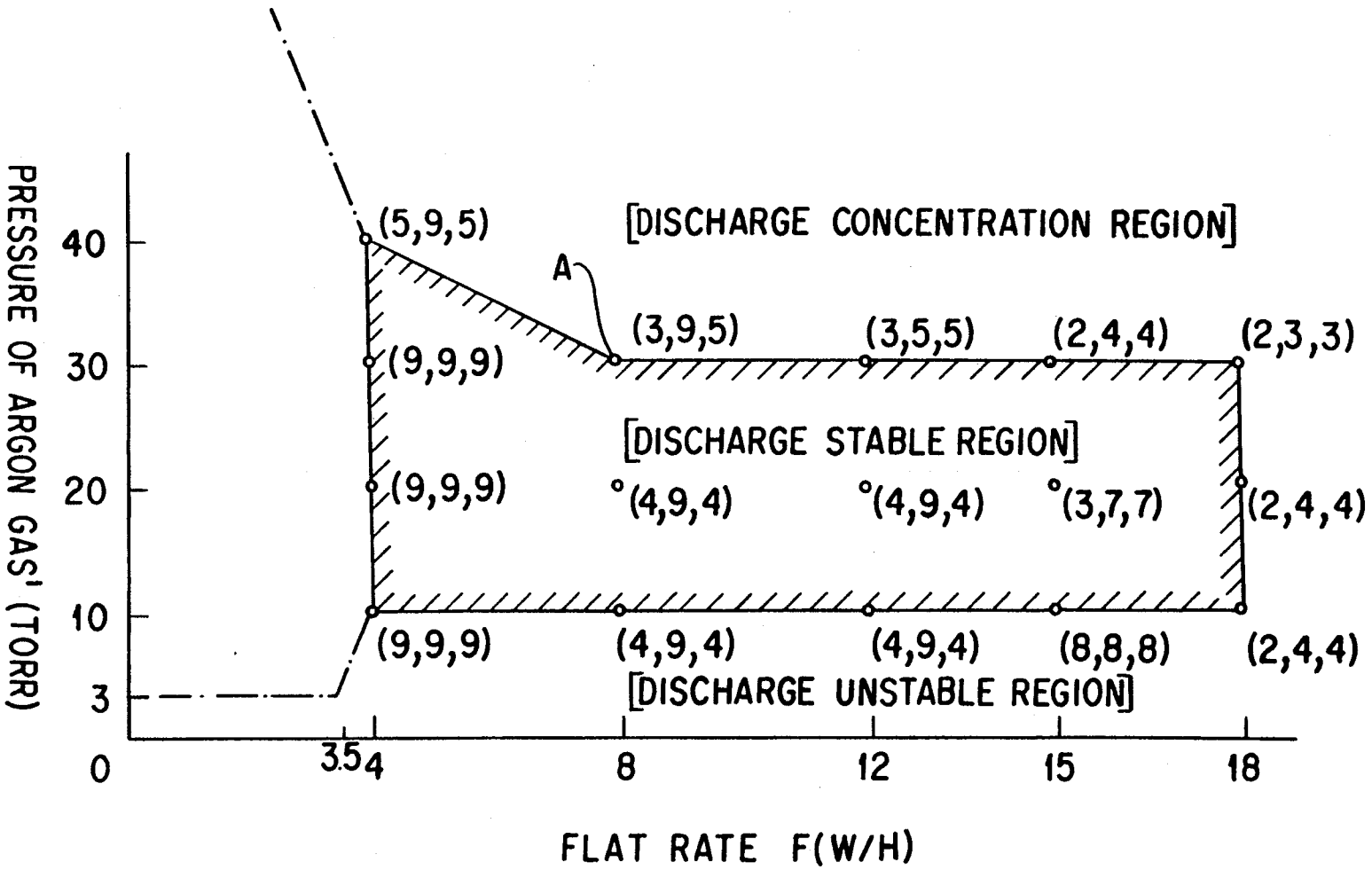
FIG. 3 is a graph showing a discharge state of the flat type low pressure gas discharge lamp shown in FIG. 2 with respect to the relationship between the pressure of argon filled in the discharge space and the aspect ratio F of the lamp.

In FIG. 3, the area surrounded by the hatched line is a discharge stable region. As can be understood from FIG. 3, the pressure P of argon in inner space 19 satisfies the relationships of formulas (1) and (2) above. However, the undesirable discharge concentration phenomenon in which the gas discharge produced between a pair of electrodes is concentrated occurs even when various values of current density in the discharge space are selected in the region above the discharge stable region. In a discharge unstable region below the discharge concentration region in FIG. 3, it was observed that flickering or fluctuation caused by a so-called moving light stripe occured in a discharge direction or a direction perpendicular to the discharge direction, and thus, the discharge was not stable even if the current density in the discharge space was widely varied. In FIG. 3, numerals enclosed within brackets indicate values of current density ($mA/cm^2$) in the discharge space when the temperature of a coolest portion in the discharge space changes. For example, the numerals enclosed with brackets, i.e., (3, 9, 5), at the measurement point A at which the aspect ratio F is eight and the pressure P of argon is thirty express that the maximum value of current density in the discharge space is 3, 9, or 5 ($mA/cm^3$) when the temperature of the coolest portion of the discharge space is changed to 20°, 40°, or 60° C. The temperature of the coolest portion of the discharge space is a primary factor which determines the evaporating pressure of mercury filled in the discharge space. In this case, one of the corners of the discharge space is the coolest portion. A current density at each measurement point in the discharge space is calculated as follows. When the temperature of the coolest portion was 20° C., discharge occured at measurement point A, and the discharge current was 2.16 (mA). In this case, since the aspect ratio F is 8, width W is 24 (mm) if the height H is a constant value, e.g., 3 (mm), and the discharge area perpendicular to the discharge direction is 0.72 ($cm^2$). Thus, the current density calculated by dividing the discharge current, i.e., 2.16 (mA), by the discharge area, i.e., 0.72 ($cm^2$), is 3 ($mA/cm^2$). In the same manner as described above, each current density was calculated when the temperature of the coolest portion was 40° and 60° C.

It should be noted that, in the area at which the aspect ratio F is less than 4, a stable discharge is achieved even if the pressure P of argon is greatly varied as long as the pressure P is in a region defined by the dot and dashed lines shown in FIG. 3.

Figure 4A:
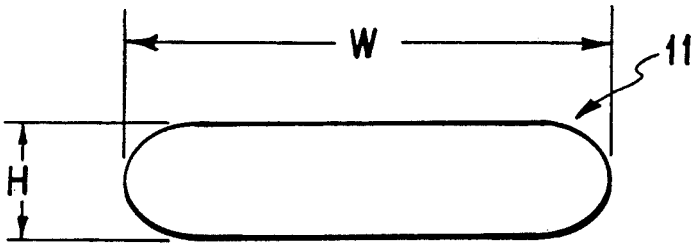
FIG. 4 (*a*) is a cross sectional view illustrating one example of the flat type low pressure gas discharge lamp.
Figure 4B:
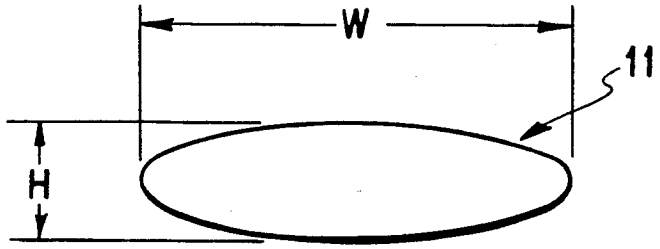

In the above-described embodiment, the invention is applied to a rectangular shaped flat type fluorescent lamp. However, the invention may be applied to a flat type fluorescent lamp having an eliptical section such as shown in FIGS. 4 (*a*) and 4 (*b*). In those cases, the width W of the aspect ratio F is indicated by an elongated axis of the eliptical section, and the height H is indicated by an axis perpendicular to the elongated axis. 100% argon was filled as a rare gas in the inner space of the fluorescent lamp of the embodiment of FIG. 3. However, a similar result was also achieved when a small amount, e.g., within 10 mol % of the argon fill, of a rare gas other than argon is mixed with argon. Furthermore, the 40 kHz sine wave voltage was applied to the fluorescent lamp in the experiment. However, a square wave or triangular wave voltage of 10 ~ 100 kHz may be applied to the fluorescent lamp, and similar results can be obtained.

In the above-described embodiment, the present invention has been applied to one type of a low pressure gas discharge lamp (fluorescent lamp). However, the invention may be applied to another type of the low pressure gas discharge lamp in which gas filled in the discharge space emits light.

With the above-described embodiment, since the pressure P of a rare gas mainly consisting of argon filled in the discharge space satisfies a prescribed relationship, i.e., $10 \leqq P \leqq -5/2 \times (F-4)+40$, when the aspect ratio F is equal to or greater than four and is equal to or less than eight and the pressure P of the rare gas satisfies a predetermined relationship, i.e., $10 \leqq P \leqq 30$, when the aspect ratio F is equal to or greater than eight and is equal to or less than eighteen, the aspect ratio F can be increased greatly, and a stable discharge also can be achieved. Therefore, when the flat type low pressure gas discharge lamp of the invention is used as backlighting for a liquid crystal display apparatus, a uniform brightness on the display surface can be achieved. In addition, the liquid crystal display apparatus can achieve a decrease in thickness, as compared with the conventional apparatus. The liquid crystal display apparatus also can achieve an increase in the display surface for the same thickness of the conventional apparatus.

Figure 5:
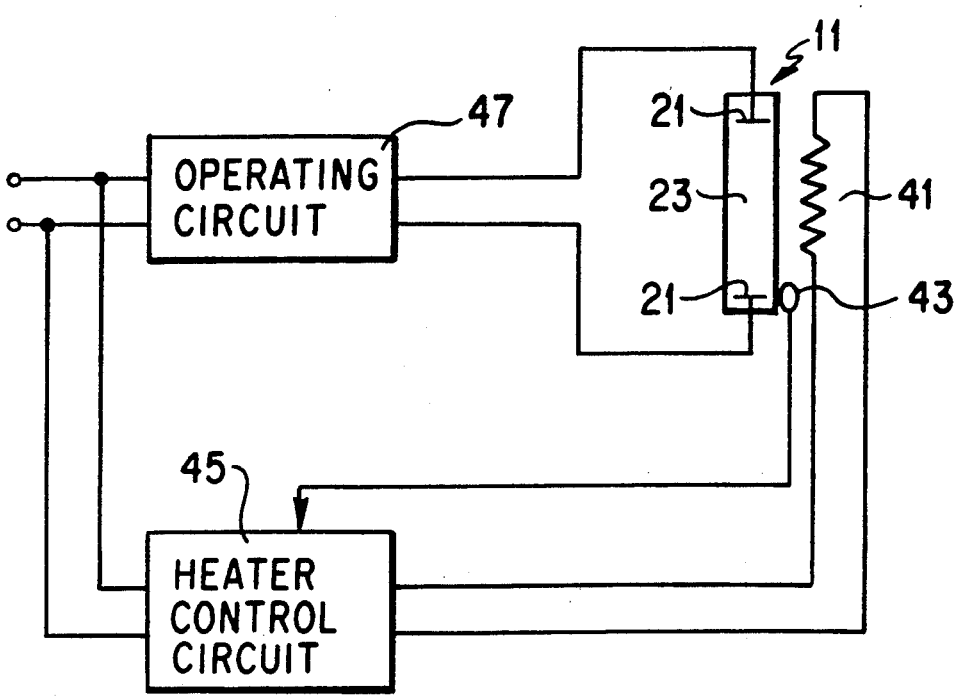
FIG. 5 is a block diagram illustrating another embodiment of the present invention.

A second embodiment of the present invention will now be described with reference to FIG. 5. In this embodiment, a heater 41, a temperature sensor 43 and a heater control circuit 45 are provided to maintain the current density of discharge space 23 at a suitable value by regulating the temperature of the wall surface of lamp 11. Heater 41 is mounted on the backside of lamp 11 to heat lamp 11. Temperature sensor 43 is arranged at the backside of lamp 11 to detect the temperature of the wall surface of lamp 11 and outputs a signal indicating the temperature of the wall surface of lamp 11 to heater control circuit 45. The wall surface temperature of lamp 11 is directly proportional to the temperature of the coolest portion of discharge space 23 of lamp 11. However, the wall surface temperature of lamp 11 becomes substantially equal to the temperature of the coolest portion of discharge space 23 when heater 11 is energized if heater 41 is arranged over the entire area of the backside of lamp 11. When lamp 11 is operated by an operating circuit 47, the temperature of the wall surface of lamp 11 is detected by sensor 43. If the temperature of the wall surface of lamp 11 is lower than a prescribed maximum value, heater 41 is energized by heater control circuit 45. Thus, lamp 11 is heated and the temperature of the wall surface of lamp 11 increases to the maximum value to maintain a stable discharge of lamp 11. Thus, lamp 11 achieves a stable discharge and a maximum light output (brightness). A desirable brightness may be achieved when the current density of discharge space 23 is regulated at a suitable value below a maximum current density which is determined by the temperature of the wall surface of lamp 11.

In a practical manner, according to FIG. 3, when aspect ratio F is 12 and the pressure of argon is 20 torr, the current density of discharge space 23 should be controlled to less than 9 $mA/cm^2$ if the temperature of the coolest portion of discharge space 23 is 60° C. The temperature of the wall surface of lamp 11 is controlled at 60° C. by heater 11 on the basis of the detection result of sensor 43. A desirable brightness can be achieved without causing an unstable discharge when the current density of discharge space 23 is regulated at a suitable value below 9 $mA/cm^2$. The above-described lamp device of the second embodiment is suitable for a light source with a liquid crystal display for automobile use or desk-top use in which insufficient power can be provided for a heater power source.

Figure 6:
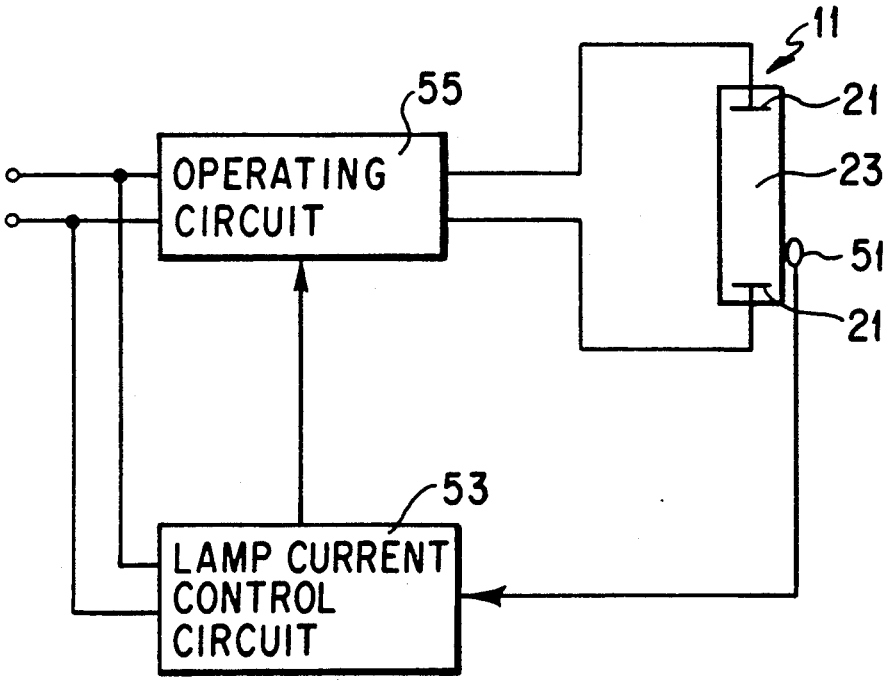
FIG. 6 is a block diagram illustrating yet another embodiment of the invention.

A third embodiment of the present invention will be described with reference to FIG. 6. In the third embodiment, a temperature sensor 51 and a lamp current control circuit 53 are provided to control the current density of discharge space 23. A control signal is generated by lamp current control circuit 53 on the basis of a temperature signal fed from sensor 51 which detects the wall surface temperature of lamp 11. A voltage supplied to the pair of electrodes 21 is controlled to a prescribed value by operating circuit 55 in accordance with the control signal fed from lamp current control circuit 53 to regulate the current density of discharge space 23 at a maximum value which can be obtained at a current atmospheric (ambient) temperature.

In accordance with FIG. 3, when the aspect ratio F is 12 and the pressure of argon is 30 torr, the current density of discharge space 23 should be controlled at 3 $mA/cm^2$ if the temperature is 20° C. In this case, if the current atmospheric temperature is changed from 20° C. to 40° C., the current density of discharge space 23 should be changed to 5 $mA/cm^2$. Changes in brightness of the above-described lamp device of the third embodiment depends on the current atmospheric temperature. However, brightness of the lamp device of the third embodiment is not greatly changed in practice when lamp 11 is once heated up because of the discharge. Thus, it may be used with a battery powered liquid crystal display which is inadequate to supply power to a heater.

The present invention has been described with respect to a specific embodiment. However, other embodiments based on the principles of the present invention will be obvious to those of ordinally skill in the art. Such embodiments are intended to be covered by the claims.

What is claimed is:

1. A flat type low pressure gas discharge lamp for radiating light comprising:

a lamp body which defines an internal gas discharge space having a substantially rectangular cross section orthogonal to the direction of discharge of width W and height H;

first and second electrode means disposed in the lamp body and arranged for generating an alternating gas discharge therebetween when a potential is applied thereto; and a fill gas including argon at a pressure P (torr) in the discharge space, the pressure P satisfying the following relationship:

(i) when the aspect ratio F defined as the ratio W/H is equal to or greater than four (4) and is equal to or less than eight (8), $$10 \leqq P \leqq -5/2(F-4)+40 \text{ and}$$

(ii) when the aspect ratio F is equal to or greater than eight (8) and is equal to or less than eighteen (18), $$10 \leqq P \leqq 30.$$

2. A lamp according to claim 1, wherein the lamp body includes a fluorescent material.

3. A lamp according to claim 2, wherein the fill gas further includes an amount of a rare gas other than argon.

4. A lamp according to claim 1, wherein the first and second electrode means include respective plate shaped electrode elements, having substantially rectangular discharge surfaces.

5. A lamp according to claim 1, wherein the lamp body includes a rectangular shaped base plate, a frame shaped side wall extending from the surface of the base plate, and a rectangular shaped light permeable plate fixed on the extended edge of the side wall to define an inner space.

6. A lamp according to claim 5, wherein the first and second electrode means include respective plate shaped electrode elements oppositely disposed one to the other at a prescribed distance in the inner space to define the discharge space therebetween.

7. A flat type low pressure gas discharge lamp comprising:

lamp body including a rectangular shaped base plate, a frame shaped side wall extending from the surface of the base plate, and a rectangular shaped light permeable plate fixed on the extended edge of the side wall to define an inner space;

a pair of plate shaped electrodes oppositely disposed one to the other at a prescribed distance in the inner space to define the discharge space therebetween, the pair of electrodes generating an alternating discharge in the discharge space when a given potential is applied thereto; and a fill gas including mercury and argon of a target pressure P (torr) in the discharge space, the target pressure P of argon satisfying the following relationship:

(i) when an aspect ratio F defined by the ratio of a width W of the surface of the base plate exposed in the discharge space in a direction perpendicular to the discharge direction to a height H of the surface of the side wall exposed in the discharge space in the direction perpendicular to the discharge direction is equal to or greater than four (4) and is equal to or less than eight (8), $$10 \leqq P \leqq -5/2(F-4)+40 \text{ and}$$

(ii) when the aspect ratio F is equal to or greater than eight (8) and is equal to or less than eighteen (18), $$10 \leqq P \leqq 30.$$

8. A flat type low pressure gas discharge lamp apparatus for radiating light comprising:

a lamp body which defines an internal gas discharge space having a substantially rectangular cross section orthogonal to the direction of discharge of width W and height H;

first and second electrode means disposed in the lamp body and arranged for generating an alternating gas discharge therebetween when a potential is applied thereto;

a fill gas consisting essentially of argon at a pressure P (torr) in the discharge space, the pressure P satisfying the following relationship:

(i) when the aspect ratio F defined as the ratio W/H is equal to or greater than four (4) and is equal to or less than eight (8), $$10 \leqq P \leqq -5/2(F-4)+40 \text{ and}$$

(ii) when the aspect ratio F is equal to or greater than eight (8) and is equal to or less than eighteen (18), $$10 \leqq P \leqq 30; \text{ and}$$

means for controlling the temperature of the lamp body to maintain the current density in the internal gas discharge space at a substantially constant value thereby controlling the brightness of the radiated light and stabilizing the alternating gas discharge.

9. An apparatus according to claim 8, wherein the means for controlling the temperature includes a heater and a temperature sensor which detects the temperature of the lamp body.

10. A flat type low pressure gas discharge lamp device comprising:

lamp body including a rectangular shaped base plate, a frame shaped side wall extending from the surface of the base plate, and a rectangular shaped light permeable plate fixed on the extended edge of the side wall to define an inner space;

a pair of plate shaped electrodes oppositely disposed one to the other at a prescribed distance in the inner space to define the discharge space therebetween, the pair of electrodes generating an alternating discharge in the discharge space when a given potential is applied thereto;

a fill gas including mercury and argon of a target pressure P (torr) in the discharge space, the target pressure P of argon satisfying the following relationship:

(i) when an aspect ratio F defined by the ratio of a width W of the surface of the base plate exposed in the discharge space in a direction perpendicular to the discharge direction to a height H of the surface of the side wall exposed in the discharge space in the direction perpendicular to the discharge direction is equal to or greater than four (4) and is equal to or less than eight (8), $$10 \leqq P \leqq -5/2(F-4)+40 \text{ and}$$

(ii) when the aspect ratio F is equal to or greater than eight (8) and is equal to or less than eighteen (18), $$10 \leqq P \leqq 30;$$

sensor means for detecting the temperature of the base plate;

a heater mounted on the base plate; and means for controlling the heater to maintain the temperature of the base plate at a substantially constant value to control the current density of the discharge space in response to the detection result of the sensor means thereby achieving the stable brightness of the radiated light.

11. A flat type low pressure gas discharge lamp apparatus for radiating light comprising:

a lamp body which defines an internal gas discharge space having a substantially rectangular cross section orthogonal to the direction of discharge of width W and height H;

first and second electrode means disposed in the lamp body and arranged for generating an alternating gas discharge therebetween when a potential is applied thereto;

a fill gas consisting essentially of argon at a pressure P (torr) in the discharge space, the pressure P satisfying the following relationship:

(i) when the aspect ratio F defined as the ratio W/H is equal to or greater than four (4) and is equal to or less than eight (8), $$10 \leqq P \leqq -5/2(F-4)+40 \text{ and}$$

(ii) when the aspect ratio F is equal to or greater than eight (8) and is equal to or less than eighteen (18), $$10 \leqq P \leqq 30;$$

sensor means for detecting the temperature of the lamp body;

lamp current control means responsive to the sensor means for controlling the current density in the internal gas discharge space to control the brightness of the radiated light and stabilize the alternating gas discharge.

* * * * *